United States Patent [19]

Shaull

[11] 4,300,241

[45] Nov. 17, 1981

[54] GARMENT AND METHOD OF MAKING SAME

[76] Inventor: Cecelia A. Shaull, 27685 Avondale, Inkster, Mich. 48141

[21] Appl. No.: 137,304

[22] Filed: Apr. 4, 1980

[51] Int. Cl.[3] ..... A41B 9/00

[52] U.S. Cl. ..... 2/400; 2/408

[58] Field of Search ..... 2/400, 408, 114, DIG. 7

[56] References Cited

U.S. PATENT DOCUMENTS

| | | | |
|---|---|---|---|
| 852,364 | 4/1907 | Wheeler | 2/408 |
| 1,895,343 | 1/1933 | Pickett | 2/408 |
| 3,855,635 | 12/1974 | Ramirez | 2/DIG. 7 |

*Primary Examiner*—Doris L. Troutman

*Attorney, Agent, or Firm*—John W. Linkhauer

[57] ABSTRACT

Disclosed is a unitary, disposable panty-type garment with an open crotch portion, intended for use by female patients undergoing gynecological examination. Also disclosed is a method of making such a garment by cutting from a web identical blank pieces which have wider and narrower portions in such manner that wider portions of a first blank are cut from a portion of the web adjacent to the portion from which narrower portions of neighboring blank pieces are cut. This saves material. Also disclosed is a concept of providing, as an article of manufacture, a two-blank portion of web which has adhesive or similar joining means provided at certain seam areas and dart areas, whereby there may be fashioned by the user a garment of appropriate dimensions.

4 Claims, 9 Drawing Figures

GARMENT AND METHOD OF MAKING SAME

BACKGROUND OF THE INVENTION

1. Field of the Invention

This invention relates to an inexpensive, disposable garment to be worn by patients who are about to be examined by a doctor for matters which concern the rectum or the genito-urinary tract. In particular it relates to garments to be supplied to patients by a doctor who examines a large number of female patients.

In a method aspect, the invention relates to a method whereby such a garment is made.

In still another aspect, the invention relates to an article of manufacture comprising a pair of identical blanks provided with appropriate adhesive portions, the blanks being adapted, when separated and appropriately oriented and joined, to provide for a wearer a garment of appropriate dimensions.

2. Description of the Prior Art

In the field of medicine, the concept of providing disposable garments made of laminated tissue paper, in place of conventional garments of cloth, is well known. Especially where it is considered important that the garment in question be sterile, as in the case of a surgeon's gown, but also in the case of other garments for which sterility is not necessarily an important consideration, it is generally known that the cost of even a single laundering, let alone an autoclaving to obtain sterility, far exceeds the cost of providing a used-once paper garment. The difference in cost, laundering versus disposable garment, is on the order of between 10 and 50 to 1. In other words, it is known that for items such as drapes for an examining table or gowns, it is conceivable that a disposable paper item can be provided at under 10 cents each, whereas a single laundering of a single unit of the same item costs about two dollars. This being the case, there has been a tremendous incentive in the medical-garment area to adopt the use, where possible, of disposable garments, so much so that special-purpose garments made of cloth may now be considered obsolete.

The prior art contains various patents which relate to the same area of use, such as Djorup U.S. Pat. No. 2,593,121 and to a lesser extent, also U.S. Pat. Nos. 2,692,989; 3,160,891; 3,399,406; and 3,351,301. To consider the garment strictly in terms of its structure, no attention being paid to the material of which it is made or the manner in which the garment is made and used, the garment in the present invention is structurally similar to those shown in U.S. Pat. Nos. 1,973,963; 2,477,593; and 2,396,599, especially when (in each case) the crotch strap is removed. As furnishing examples of the prior art concerned with methods of making such garments, there may be considered U.S. Pat. Nos. 2,696,445 and 4,052,752.

Because of a technique which has only recently begun to be practiced on a substantial scale, there is likely to be a greater demand for a garment according to the invention that one might otherwise expect. Until rather recently, it was usual to conduct a Pap smear test only annually, but lately, more doctors are recommending that such a test be conducted every six months. Because of the above-mentioned technique, it is now possible to draw material from the uterus into the vagina, and this makes it possible with the Pap smear test to detect uterine cancer at an earlier stage. Moreover, though at one time many doctors did not recommend or require periodic gynecological examinations for women under age 35 or 40, it is now a standard practice to require a Pap smear test at periodic intervals, before renewing a prescription for birth-control pills. In other words, it is becoming increasingly common to conduct such examinations also upon women in the age bracket of 15 to 35.

SUMMARY OF THE INVENTION

Disclosed is a unitary, disposable panty-type garment with an open crotch portion, intended for use by female patients undergoing gynecological examination. Also disclosed is a method of making such a garment by cutting from a web identical blank pieces which have wider and narrower portions in such manner that wider portions of a first blank are cut from a portion of the web adjacent to the portion from which narrower portions of neighboring blank pieces are cut. This saves material. Also disclosed is a concept of providing, as an article of manufacture, a two-blank portion of web which has adhesive or similar joining means provided at certain seam areas and dart areas, whereby there may be fashioned by the user a garment of appropriate dimensions.

DESCRIPTION OF THE DRAWINGS

A complete understanding of the invention may be obtained from the foregoing and following description thereof, taken in conjunction with the appended drawings, in which.

DESCRIPTION OF THE PREFERRED EMBODIMENTS

The present invention relates to a medical garment, and in particular, to a panty-type garment, especially one of the kind used by a doctor examining a large number of female patients.

While in the past, various practices have been followed in connection with the handling of female patients by a doctor and his nurse in respect to the provision of gowns and/or draping, it has been apparent to those concerned that the practices hitherto known have had various drawbacks.

It has been usual, of course, to do at least something in the direction of providing gowns and/or drapes in order to decrease the physical and/or mental discomfort of the patient. In other words, it has been usual to provide a gown and/or a drape, the latter possibly being in the form of a simple sheet, although that practice has drawbacks as discussed in U.S. Pat. No. 2,593,121.

As has been discussed above, it has been found especially desirable in the medical-garment field to use, where possible, disposable garments made of laminated tissue paper or the like, rather than garments made of cloth. Even with the considerable saving in overhead costs in terms of laundering that is possible with the use of, for example, disposable gowns, there remains the problem that it would for many purposes be desirable to provide a garment more specifically intended to cover just the region of the waist and immediately below, extending to the thighs, in order to avoid requiring the patient to disrobe completely, as is necessary if a full gown is provided. Moreover, a disposable garment of the kind herein proposed has advantages in terms of requiring less material and being available at lower cost, in comparison with a full gown. Moreover, in accordance with one feature of the invention, there is provided a disposable garment of this kind which is admirably adapted to be adjusted to suitable or appropriate dimensions such as to conform with the requirements of the wearer.

Figure 1:
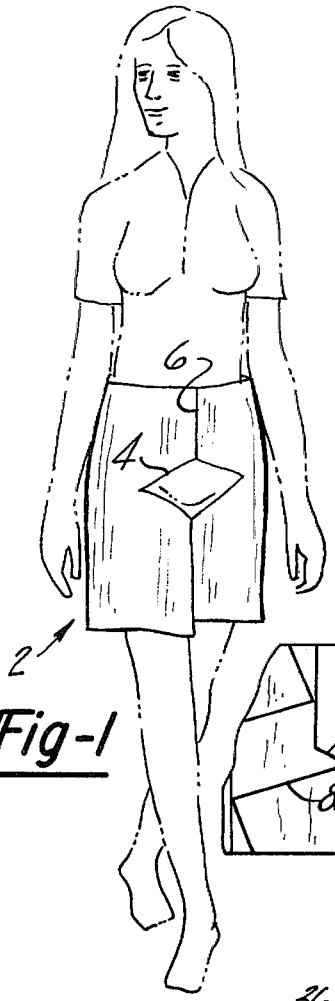
FIG. 1 is a perspective view of a first embodiment of a garment according to the present invention.

A clear idea of the nature of the garment of the present invention may be obtained from a perspective view thereof depicted in FIG. 1. As there shown, the garment 2 simply comprises a loose-fitting (as opposed to form-fitting, like a panty girdle) panty garment which is made of disposable material and which has an opening crotch portion 4. Also appearing in FIG. 1 is a central front seam 6.

It is maintained that such a garment has been unobvious to those skilled in the art, who have not appreciated the reasons for making and using any garment quite so revealing. There is a tendency on the party of those not familiar with the preparation of female patients who are about to undergo a gynecological examination to believe that the average patient would be as content to remain completely uncovered as to wear, before and during the examination, a garment of the kind described. It is found, however, that such is not the case. Both some patients and also some doctors derive a degree of mental comfort from the consideration that a proper draping of the body tends to some degree to impart to the examination procedure a degree of formality and professionalism which would otherwise be lacking. There is also the important consideration that it is generally not practiced to provide the examination table with internal heating means, and as a result, its surface initially feels cold to the patient where it comes into contact with the patient's uncovered skin. This creates unnecessary physical discomfort which adds to the other discomfort felt by the patient who is being prepared for, or is undergoing, a gynecological examination. Thus, there is need and good reason for the use of a garment of the kind described.

Figure 2:
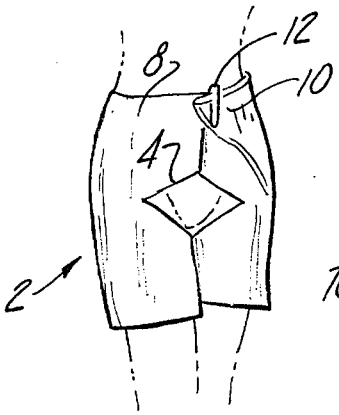
FIG. 2 is a perspective view of a first alternative embodiment of a garment according to the present invention.

An alternative form of the garment is shown in FIG. 2. In this embodiment, the garment 2 has its front portion closed and brought into comformity with the dimensions of the wearer by securing overlapping parts 8 and 10 at the waist of the garment by suitable means such as a clip or clasp 12. Those skilled in the art will understand that with a garment of this sort, the clip or clasp 12 may be provided either to the front or to the rear of the garment.

Figure 3:
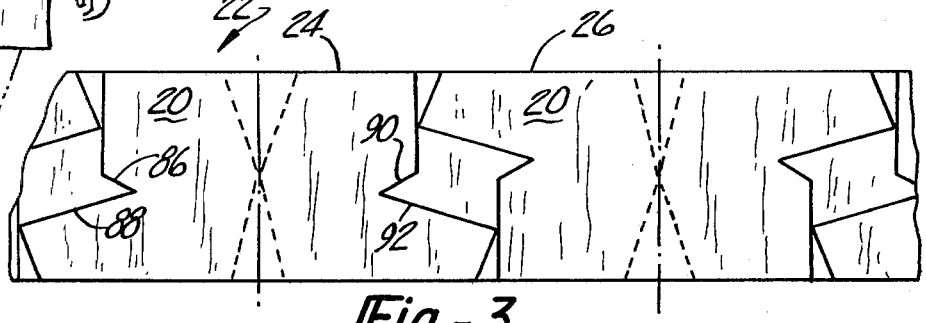
FIG. 3 is a representation of a portion of a web from which there is made a garment in accordance with the present invention.

The garment is preferably made from a pair of identical blanks 20 and 20'. As best seen in FIG. 3, it will be desirable for purposes of economy to cut such blanks from a web 22 of double- or multiple-ply tissue paper or other suitable material in such fashion that as one travels along one edge of the web 22 from which the blanks 20, 20' are cut, one encounters, alternately, the narrower top side 24 of the blank 20 and then the wider bottom side 26 of a blank 20'. It will be appreciated that this practice of alternating the orientation of the blanks 20, 20' serves to minimize the quantity of web material which is required in order to form a garment according to the invention.

Figure 4:
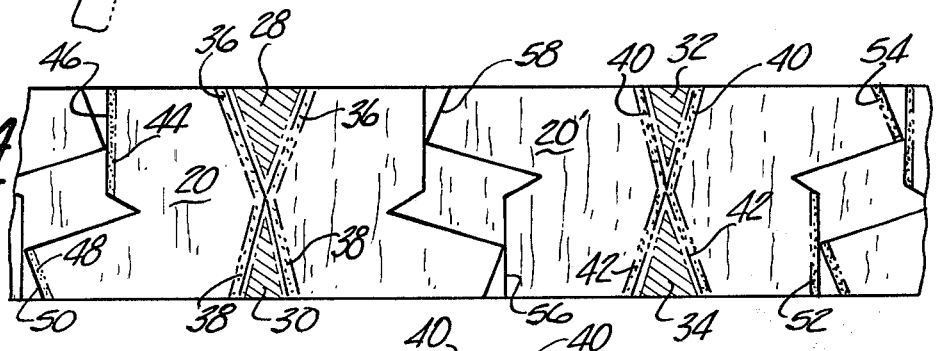
FIG. 4 is a representation of the same web at a subsequent phase of processing (after application of adhesive), showing a two-blank unit comprising an article of manufacture according to the present invention.

A subsequent stage in the fashioning of a garment in accordance with the method of the invention is shown in FIG. 4. In FIG. 4, there are shown various dart areas 28, 30, 32 and 34, and adjacent to the edges thereof, there are areas 36, 38, 40 and 42 respectively which are provided with adhesive or other suitable material, as shown. Also provided with adhesive are, as shown, an area 44 of a blank 20 in the vicinity of a mid-seam (front or rear) 46 and an area 48 which lies adjacent to a thigh seam 50. The blank 20', which is identical to the blank 20 except for its orientation in respect to the web 22, is similarly provided with areas 52 and 54, which correspond to the areas 44 and 48, respectively.

The two-blank unit, comprising the blanks 20 and 20', shown in FIG. 4, may be considered as an article of manufacture suitable for subsequent use in fashioning a garment having dimensions which are particularly appropriate or suitable for the wearer. The manner of further assembly and using the garment, starting with such a two-piece unit, will now be explained.

Figure 5:
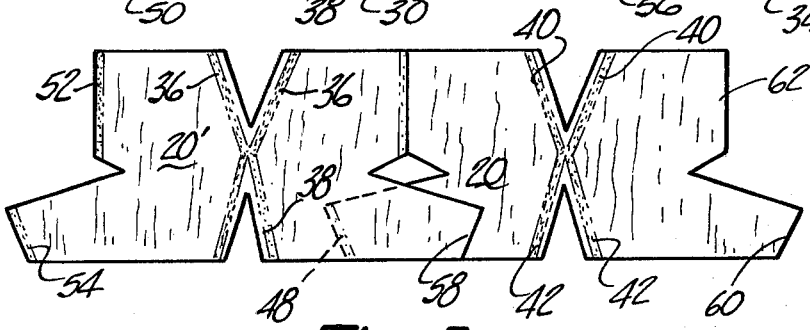
FIG. 5 is a representation of a still later stage in the making of a garment according to the present invention.

After the blanks 20 and 20' have been separated from the web 22, the portion 56 of the blank 20' is brought so that it overlies the adhesive area 44. This creates a structure such as shown in FIG. 5, from which it is possible to make a garment according to the invention by forming a first leg, by joining the part 58 of the blank 20' to the area 54, and then to form a second leg by joining the part 60 of the blank 20' to the area 54. The garment is then completed by joining the area 62 of the blank 20 to the area 52 of the blank 20', and then, by using the areas 36, 38, 40 and 42, taking the darts 28, 30, 32 and 34 respectively.

To be somewhat more precise about the manner in which the above-indicated transformation to form the final garment is done, it may be considered that one starts with the pair of joined blanks 20' and 20 in a plane such that of the drawing or a table top, and then the parts 54 and 58 are raised and joined, i.e., moved in a particular sense or direction, namely (in this case) towards the observer, and then the parts forming the other leg, namely, parts 48 and 60, area also raised and joined, i.e., moved in the same sense or direction. Then, the parts 52 and 62 are likewise moved in the same sense or direction.

In accordance with one manner of proceeding, a garment of desired size (small, medium, large, or extra-large) is provided, using blanks 20, 20' of appropriate size and if this is done, it may be desirable merely to provide blanks which have indentations at the locations of the above-mentioned darts, thereby making a subsequent step of cutting away the dart material unnecessary. In accordance with an alternative mode of proceeding, the extent of overlap used in the formation of the various seams and darts may be varied to suit the requirements of the intended wearer, and in this case, the material comprising the above-mentioned darts may, if desired, be removed by cutting or other suitable means, thereby leaving a garment in finished form, as shown in FIG. 6.

Figure 7:
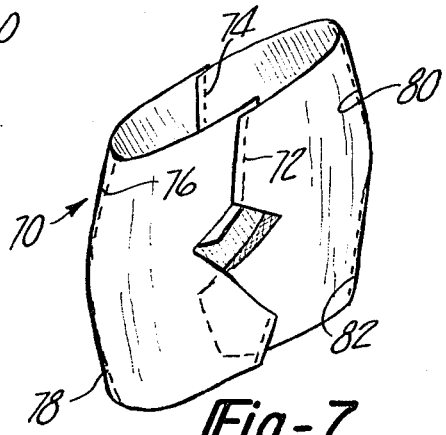
FIG. 7 is a perspective view of a second alternative embodiment of a garment according to the present invention.
Figure 6:
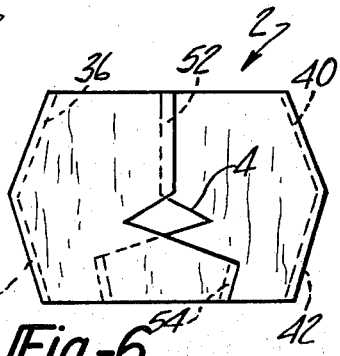
FIG. 6 is a representation of the garment of FIG. 5 in its assembled form.

In FIG. 7, there is shown an alternative embodiment of the invention wherein there is provided a unitary, open-crotch garment 70 made of disposable material, the particular difference being that in place of the use of adhesive, there are provided stitched seams 72 and 74 as front and rear middle seams, respectively, and stitched seams 76, 78, 80 and 82 in place of the adhesively joined seams 36, 38, 40, and 42, respectively, in the garment of FIG. 6.

Figure 8:
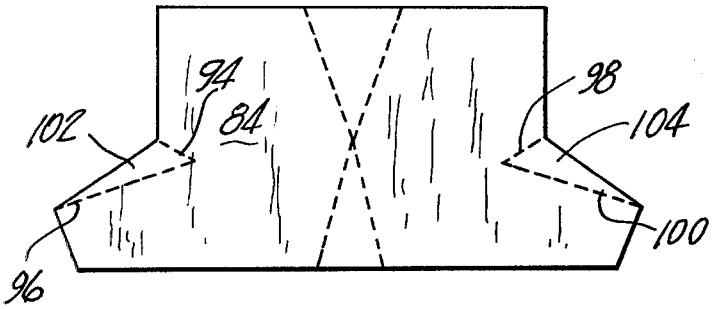
FIG. 8 represents an alternate form of blank used for making a third alternative embodiment of the invention.
Figure 9:
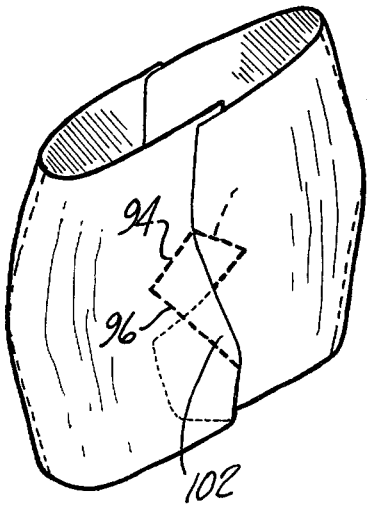
FIG. 9 is a perspective view of a garment made with the use of blanks of the kind shown in FIG. 8.

In FIG. 8, there is shown a blank 84 which corresponds to the blank 20, except that in place of the edges 86, 88, 90 and 92 corresponding to the outline of the crotch opening, there are providing perforations 94, 96, 98 and 100, respectively, so that the blank also has portions 102 and 104 which are removably joined to the remainder of the garment through such perforations. With the use of a pair of blanks 84 and by joining them in substantially the manner described above, there is made a garment such as that depicted in FIG. 9. It will be apparent that when such a garment is used, the removably secured portions 102, 104 from a first blank 84 and the corresponding portions from the other blank are simply torn or clipped off by the doctor or otherwise removed. This alternative embodiment has the disadvantage of requiring such removal as a separate step, but the compensating advantage of providing improved coverage of the patient in the interval between when the garment is put on and when the examination begins. Adoption of the use of this embodiment does not interfere in any way with the use of the material-saving feature disclosed above in connection with the discussion of FIG. 3.

In accordance with the principles disclosed above, there is provided an inexpensive disposable garment, suitable for preserving the modesty of the wearer to an extent consistent with the circumstances and for preventing discomfort by reason of contact of the skin of the wearer with the examination table. The invention further includes, as disclosed above, aspects in respect to decreasing the cost of manufacture of the garment and affording also, in some cases, suitable adjustability in respect to the dimensions employed, in order to match better the requirements of the wearer.

While I have shown and described herein a certain embodiment of my invention, I intend to cover as well any change or modification therein which may be made without departing from its spirit and scope.

I claim as my invention:

1. A disposable, loose-fitting panty-type garment having an openable crotch portion, said garment comprising first and second panels of substantially identical dimensions and said garment being of relatively simple construction yet possessing the capability of being fitted conveniently to suit the dimensions of a wearer of said garment without change in the dimensions of said panels, said panels each comprising a narrower-side portion in the shape of an oblong, a first one of the two longer sides of said oblong forming a narrower-side edge of said panel; a central portion in the shape of a first trapezoid, the shorter of the two parallel sides of said trapezoid coinciding with a second and opposite one of the aforesaid two longer sides of said oblong; and a longer-side portion in the shape of a second trapezoid, said second trapezoid having longer and shorter parallel sides, the longer of the parallel sides of said second trapezoid coinciding with the longer of the parallel sides of said first trapezoid and the shorter of the parallel sides of said second trapezoid forming a longer-side edge of said panel parallel to said narrower-side edge of said panel, each of said panels further containing, in said central portion and in the vicinities of the ends of the lines comprising longer and parallel sides of said first trapezoid, perforations defining a portion of said panel adapted to be removed for permitting display or, or access to, the genitalia of a wearer of said garment, said garment being formed by (a) the joining of two of such panels in such manner that the shorter sides of a first one of said oblongs comprising a part of a first one of said panels are joined to the shorter sides of a second one of said oblongs comprising a part of a second one of said panels to form front central and rear central seams of said garment and (b) the joining of the nonparallel sides of the said longer-side portion of each of said panels to form right and left leg portions of said garment, the portions of the garment so formed which correspond to the portions of said panels which are centrally located with respect to the ends of such panels being capable of being joined to form upper and lower side dart portions of such dimensions as to suit the dimensions of a wearer of the garment.

2. A disposable, loose-fitting panty-type garment having an open crotch portion, said garment comprising first and second panels of substantially identical dimensions and said garment being of relatively simple construction yet possessing the capability of being fitted conveniently to suit the dimensions of a wearer of said garment without change in the dimensions of said panels, said panels each comprising a narrower-side portion in the shape of an oblong, a first one of the two longer sides of said oblong forming a narrower-side edge of said panel; a central portion in the shape of a first trapezoid, the shorter of the two parallel sides of said trapezoid coinciding with a second and opposite one of the aforesaid two longer sides of said oblong; and a longer-side portion in the shape of a second trapezoid, said second trapezoid having longer and shorter parallel sides, the longer of the parallel sides of said trapezoid coinciding with the longer of the parallel sides of said first trapezoid and the shorter of the parallel sides of said second trapezoid forming a longer-side edge of said panel parallel to said narrower-side edge of said panel, each of said panels further containing, in said central portion and in the vicinities of the ends of the lines comprising longer and parallel sides of said first trapezoid, removed portions for permitting display of, or access to, the genitalia of a wearer of said garment, said garment being formed by (a) the joining of two of such panels in such manner that the shorter sides of a first one of said oblongs comprising a part of a first one of said panels are joined to the shorter sides of a second one of said oblongs comprising a part of a second one of said panels to form front central and rear central seams of said garment and (b) the joining of the non-parallel sides of the said longer-side portion of each of said panels to form right and left leg portions of said garment, the portions of the garment so formed which correspond to the portions of said panels which are centrally located with respect to the ends of such panels being capable of being joined to form upper and lower side dart portions of such dimensions as to suit the dimensions of a wearer of the garment.

3. As an article of manufacture, a section of web material containing two blanks of identical dimensions, said blanks each having a narrower-side edge and a longer-side edge parallel to said narrower-side edge, said blanks being oriented with respect to said web in such manner that a narrower-side edge of a first of said blanks is located adjacent to a longer-side edge of a second of said blanks, whereby a saving in the total amount of web and material is obtained, each of said blanks comprising a narrower-side portion in the shape of an oblong, a first one of the two longer sides of said oblong forming a narrower-side edge of said blank; a central portion in the shape of a first trapezoid, the shorter of the two parallel sides of said trapezoid coinciding with a second and opposite one of the aforesaid two longer sides of said oblong; and a longer-side portion in the shape of a second trapezoid, said second trapezoid having longer and shorter parallel sides, the longer of the parallel sides of said second trapezoid coinciding with the longer of the parallel sides of said first trapezoid and the shorter of the parallel sides of said second trapezoid forming a longer-side edge of said blank parallel to said narrower-side edge of said blank, each of said blanks further containing, in said central portion and in the vicinities of the ends of the lines comprising longer and parallel sides of said first trapezoid, perforations defining a portion of said blank adapted to be removed for permitting display of, or access to, the genitalia of a wearer of a garment made from said article of manufacture.

4. As a article of manufacture, a section of web material containing two blanks of identical dimensions, said blanks each having a narrower-side edge and a longer-side edge parallel to said narrower-side edge, said blanks being oriented with respect to said web in such manner that a narrower-side edge of a first of said blanks is located adjacent to a longer-side edge of a second of said blanks, whereby a saving in the total amount of web and material used is obtained, said blanks each comprising a narrower-side portion in the shape of an oblong, a first one of the two longer sides of said oblong forming a narrower-side edge of said blank; a central portion in the shape of a first trapezoid, the shorter of the two parallel sides of said trapezoid coinciding with a second and opposite one of the aforesaid two longer sides of said oblong; and a longer-side portion in the shape of a second trapezoid, said second trapezoid having longer and shorter parallel sides, the longer of the parallel sides of said trapezoid coinciding with the longer of the parallel sides of said first trapezoid and the shorter of the parallel sides of said second trapezoid forming a longer-side edge of said blank parallel to said narrower-side edge of said blank, each of said blanks further containing, in said central portion and in the vicinities of the ends of the lines comprising longer and parallel sides of said first trapezoid, removed portions for permitting display of, or access to, the genitalia of a wearer of a garment made from said article of manufacture.

* * * * *